US009863218B2

(12) United States Patent
Farrow

(10) Patent No.: US 9,863,218 B2
(45) Date of Patent: Jan. 9, 2018

(54) PLUNGER ASSEMBLY WITH COATED DART AND WEAR PADS

(71) Applicant: James T. Farrow, Grand Prairie, TX (US)

(72) Inventor: James T. Farrow, Grand Prairie, TX (US)

( * ) Notice: Subject to any disclaimer, the term of this patent is extended or adjusted under 35 U.S.C. 154(b) by 287 days.

(21) Appl. No.: 14/702,651

(22) Filed: May 1, 2015

(65) Prior Publication Data

US 2016/0319620 A1 Nov. 3, 2016

(51) Int. Cl.
*E21B 37/00* (2006.01)
*E21B 43/12* (2006.01)

(52) U.S. Cl.
CPC ..... *E21B 37/00* (2013.01); *E21B 43/121* (2013.01)

(58) Field of Classification Search
CPC ..... E21B 37/00; E21B 34/04; E21B 37/045; E21B 37/10; E21B 43/12; E21B 43/121; E21B 43/122
USPC ..... 166/68, 105
See application file for complete search history.

(56) References Cited

U.S. PATENT DOCUMENTS

| | | | | |
|---|---|---|---|---|
| 9,109,424 | B2 | 8/2015 | Jefferies | |
| 2003/0155117 | A1 | 8/2003 | Gray | |
| 2006/0065390 | A1 | 3/2006 | Amies et al. | |
| 2009/0038796 | A1 | 2/2009 | King | |
| 2014/0246209 | A1* | 9/2014 | Themig | E21B 43/14 166/374 |
| 2014/0262204 | A1* | 9/2014 | Farris | E21B 27/02 166/68 |
| 2016/0108710 | A1 | 4/2016 | Hightower | |
| 2016/0168963 | A1* | 6/2016 | Roycroft | E21B 43/121 166/105 |

OTHER PUBLICATIONS

Office Action in related U.S. Appl. No. 14/908,112, dated Aug. 22, 2017, 13 pages.
Office Action in related U.S. Appl. No. 14/705,941, dated May 16, 2017, 13 pages.
Office Action in related U.S. Appl. No. 14/745,096, dated May 16, 2017, 14 pages.
Office Action in related U.S. Appl. No. 14/745,142, dated May 16, 2017, 16 pages.

* cited by examiner

*Primary Examiner* — David Bagnell
*Assistant Examiner* — Yanick Akaragwe
(74) *Attorney, Agent, or Firm* — Law Office of Jeff Williams; J. Oliver Williams

(57) ABSTRACT

The present application includes an assembly and method for a plunger tool configured to remove contaminants from a well bore. The assembly includes a hollowed body, a dart configured to selectively close off the passage of working fluid through the body, and a wear pad coupled to an exterior surface of the body to protect the body from corrosive wear. The assembly may further include a dart having a core member and wear coating. The dart is configured to be interchangeable within the body and without the need to disassembly the body. The wear coating compressing for insertion and being sheared off during removal the dart. The body includes an internal lip to prevent the undesired removal of the dart.

15 Claims, 4 Drawing Sheets

PLUNGER ASSEMBLY WITH COATED DART AND WEAR PADS

BACKGROUND

1. Field of the Invention

The present application relates generally to oil field devices and, more particularly, to a plunger assembly with protective coatings and pads to reduce wear.

2. Description of Related Art

The oil and gas industry has been drilling holes and removing natural crude oil for decades. Plungers are downhole tools used by operators to remove contaminants from productive natural gas wells. A plunger acts as an artificial lift. In operation the plunger passes down through the surface tubing of the well until it reaches a contact point, at which point potential energy of the plunger falling in the well acts to partially restrict the flow of working fluid through the plunger. Pressure beneath the plunger builds and raises the plunger to the surface, thereby pushing out the liquids and contaminants above the plunger.

A number of disadvantages exist with current plungers. Conventional plungers direct the flow of working fluid around the plunger and between a portion of the plunger and the tubing of the well bore. The working fluid contains small debris which can quickly wear down the surfaces of the plunger tool as it repeatedly passes through the tubing. The main body of the plunger and the dart are most susceptible. A method of protecting the body of the plunger from corrosive/abrasive wear is needed.

Another disadvantage is that the body of conventional plunger assemblies are composed of a plurality of parts that are coupled together. One reason for this is that a user desires to maintain access to the dart in case of wear or damage. The ability to dismantle a plunger assembly allows the user to remove and replace the dart. However, connections in the body often succumb to the stresses experienced within the well bore and provide a weak link. A single uniform body is needed that can allow for the removal and replacement of the dart.

Furthermore, stresses experienced by the plunger assembly at impact at the bottom of the well bore can be extreme in nature. Typically the dart is pushed to a lower position relative to the body (i.e. extending below the body) when passing down the surface tubing. At impact with a stop at the bottom of the surface tubing, the dart is abruptly pressed upward against the body. The dart experiences some of the stresses but the body of the plunger, and particularly the lower tip of the body absorbs a majority of the impact. These forces are primarily transferred to the main body through the tip of the lower body. In an attempt to avoid damage, the lower end of the body is often thickened. Despite these efforts, if the plunger is not centered in the surface tubing or aligned correctly with the stop then the lower end of the body can be damaged (i.e. bent) upon impact. An improved method of transferring the forces to the main body is desired so as to avoid damage to the lower end of the body.

Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
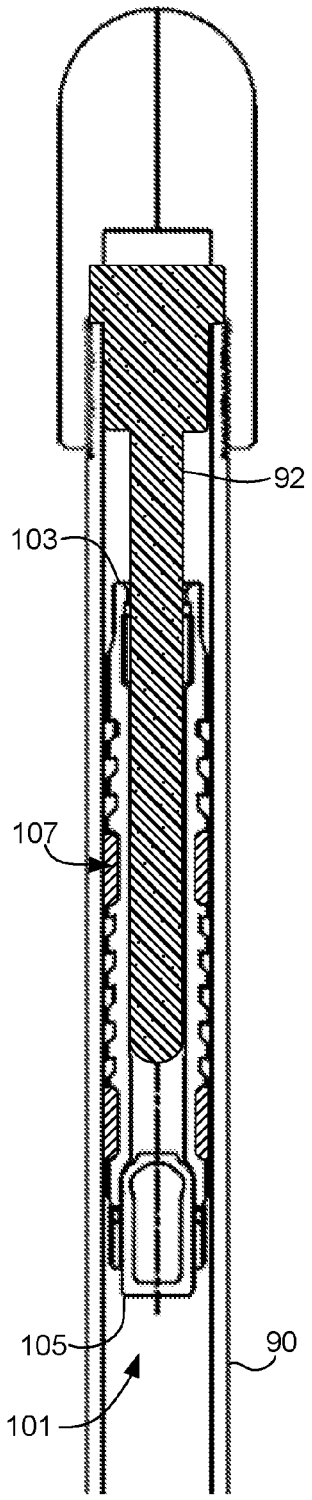
FIG. 1 is a section view of a plunger assembly approaching an upper stop at surface level according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional plunger assemblies. Specifically, the assembly of the present application is configured to provide a protective and sacrificial coating to portions of the plunger body and dart to prevent excessive wear. The wear pads are configured to be interchangeable and to accept the wear from debris and particulates in the working fluid. It is also an advantage of the present application that the assembly is configured as a single uniform body without connections that are susceptible to premature failure from stresses upon impact. Another advantage of the present application is that the dart is configured to accept and transfer impact forces to a central section of the plunger body. Routing impact forces past the lower section allows the lower section to maintain a thinner contour and avoid damage from impacting the stop. This is done by lengthening the dart so as to extend below the lower section of the plunger body when seated in both the upper seat and the lower seat. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The plunger assembly 101 of the present application is illustrated in the associated drawings. The assembly includes a plunger body having three defined sections, an upper section, a central section, and a lower section. The assembly also includes a single dart configured to be interchangeable within the plunger body and operate between one of two spherically radiused seat positions located in the lower section of the plunger body. A wear pad is included to resist permanent damage from the passing of working fluid through and around the plunger body. The wear pad extends circumferentially around the plunger body. In some embodiments, individual wear pads may be placed around the tool.

Figure 2:
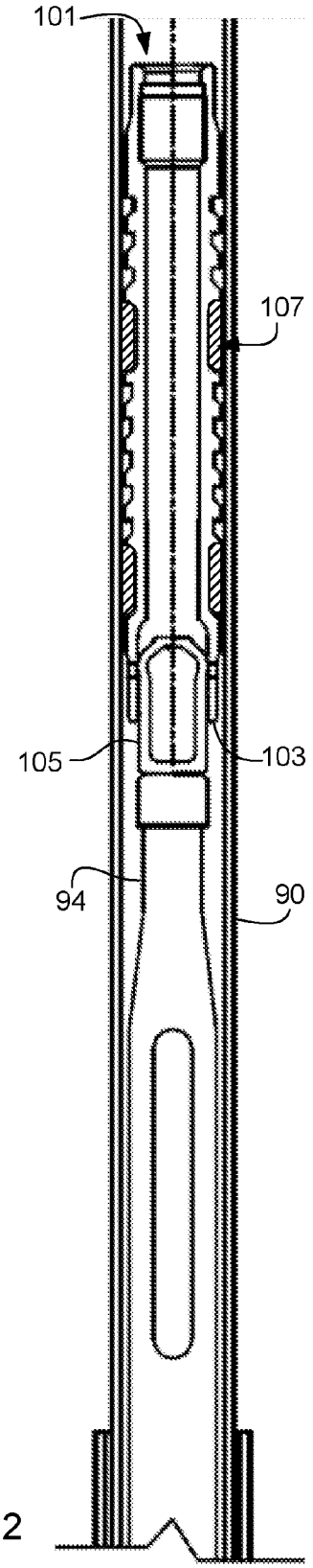
FIG. 2 is a section view of the plunger assembly of FIG. 1 striking a lower stop in the tubing.

Referring now to the drawings wherein like reference characters identify corresponding or similar elements in form and function throughout the several views. FIGS. 1 and 2 illustrate plunger assembly 101 as seen at both ends of a casing/tubing 90 at the surface. Assembly 101 includes a plunger body 103, a dart 105, and one or more wear pads 107. In FIG. 1, assembly 101 is at the upper end of the surface tubing 90 and in process of rising to permit the dart to contact a striker rod 92. Rod 92 passes through the upper section and central section of the plunger body to contact the dart. FIG. 2 illustrates plunger assembly 101 at the lower end of tubing 90 where the dart has made contact against a stop 94. The dart is illustrated as being in process of transitioning from the lower seat to the upper seat. The dart accepts and transfers the impact forces directly to the central section of the plunger body. A more detailed view of plunger assembly 101 is given in the following Figures.

It is understood that reference to a well bore includes the one or more layers of casing and piping within the well bore itself. Assembly 101 is configured to operate within surface tubing and casing in a well bore, and any other interior lining. Reference to tubing will be made for purposes of this description but is not limiting thereby.

Figure 3:
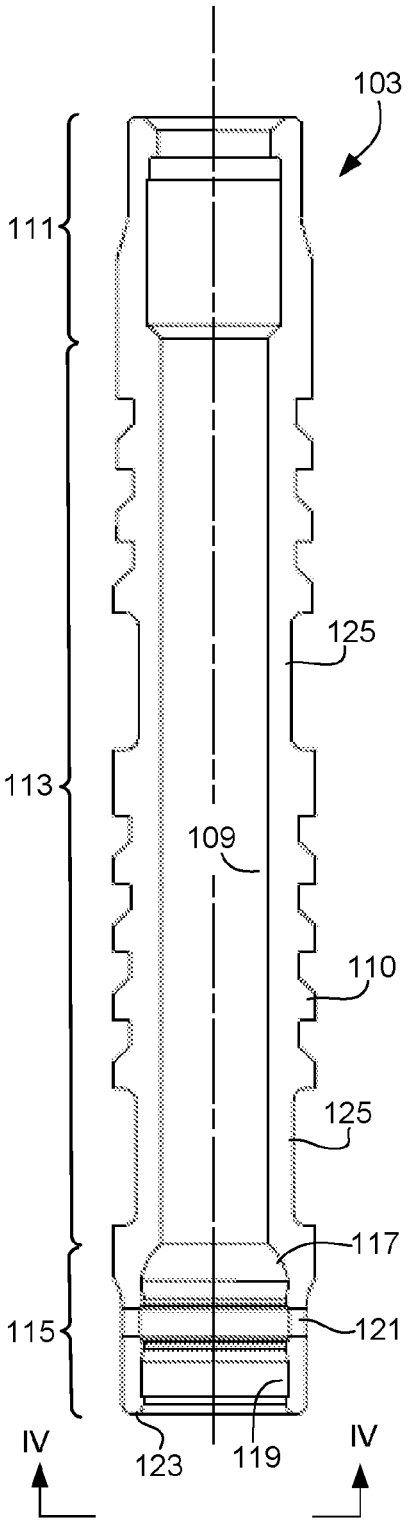
FIG. 3 is a side section view of a plunger body in the plunger assembly of FIG. 1.

Referring now also to FIG. 3 in the drawings, a side section view of plunger body 103 is illustrated. Plunger body 103 is hollowed from an upper end to a lower end and is configured to permit the passage of contaminants, particulates, gas, and other fluids through a central channel 109. An advantage of plunger body 103 is that plunger body 103 is a single unitary body having no threaded connections, couplings or pins. Body 103 is not an assembly in and of itself. As a single member, body 103 is configured to more adequately resist impact forces experienced by assembly 101.

Plunger body 103 is defined with three different sections: an upper section 111, a central section 113, and a lower section 115. Upper section 111 is configured to engage striker rod 92 at the upper end of surface tubing 90. Central section 113 houses central channel 109 and is configured with an exterior surface 110 contoured to permit plunger assembly 101 to be selectively latched onto and held in place at the upper end of surface tubing 90. Lower section 115 is configured to house seats for dart 105, namely an upper seat 117 and a lower seat 119. Additionally, lower section 115 includes one or more ports 121 configured to allow the passage of working fluid into plunger body 103 and through central channel 109, and a dart aperture 123 configured to permit the translation of dart 105 within body 103.

Figure 4:
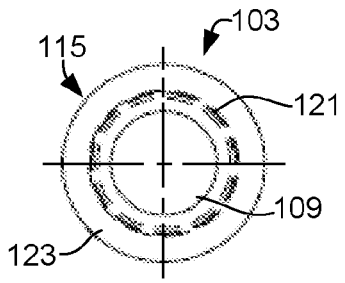
FIG. 4 is a full end view of the plunger body of FIG. 3.

Referring now also to FIG. 4 in the drawings, a full end view of plunger body 103 is illustrated. Central channel 109 is shown along with ports 121. Ports 121 are selectively sized passages that permit the flow of working fluid to pass from outside body 103 during its downward motion to enter within body 103 and pass through channel 109. One or more ports 121 are used. The collective area of ports 121 are designed to permit a sufficient flow rate through channel 109 to offset pressure gradients in tubing 90, so that assembly 101 will translate downward as needed. A series of ports 121 are spaced around the periphery of lower section 115 of body 103. It is understood that assembly 101 may include any number of ports 121 of any size, shape and spacing.

As stated previously, working fluid within tubing 90 contains a number of contaminants, debris, particulates, oils, sand, and so forth that can be abrasive and damaging to objects and tools. Even tubing 90 itself can be affected adversely over time. Tools passing within tubing 90 are exposed to a barrage of these abrasive particles and substances and regularly show signs of wear and erosion. Working fluid passes between body 103 and tubing 90 as well as within central channel 109. Assembly 101 is configured to reduce wear caused by the passage of the working fluid by including wear pads 107. Central section 111 is configured to include one or more inserts 125 to accept wear pads 107. Inserts 125 may be located at regularly spaced radial intervals around the exterior surface 110 of body 103 or at any other selected locations along body 103 as deemed necessary.

Figure 5:
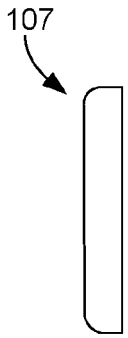
FIG. 5 is a side view of a wear pad in the plunger assembly of FIG. 1.

Referring now also to FIG. 5 in the drawings, a side view of a wear pad in plunger assembly 101 is illustrated. Wear pad 107 is configured to couple to exterior surface 110 of body 103 and protect body 103 from corrosive wear and exposure to the abrasive contaminants and particulates of the working fluid. Ideally, pads 107 are located in inserts 125 and are designed to be flush with the outer diameter of body 103 to permit sufficient clearance for the tool to translate within tubing 90. However, it is contemplated that some uses of wear pads 107 may be outside of inserts 125 and may not match the neighboring contour of body 103. For example, it is contemplated that pads 107 may be located at any location within upper section 111 and lower section 115. Pads 107 may be located in any radiused areas and may of themselves define the respective contour of body 103. In such a way, the respective interchanging of pads 107 may be used to alter the exterior and/or interior contour of body 103.

Wear pad 107 may be made from any hardened elastomeric material or other material that permits good wear resistance and accepts releasable bonding with body 103. Pads 107 use a mechanical and/or chemical method to adhere to body 103. An adhesive may be used or inserts 125 may include any one of a lip, groove, slot, or aperture for the press fit coupling of pads 107 to body 103. Any number of methods for releasable attachment are contemplated and considered within the scope of the present application.

A main feature of wear pads 107 is that they are configured to act as a sacrificial member of assembly 101. Locating wear pads 107 in key abrasive zones along body 103 allows wear pads 107 to receive the highest amount of wear. Pads 107 are configured to be interchangeable, thereby allowing a user to merely disassociate pads 107 from body 103 and reattach a new pad 107. The use of pads 107 can greatly increase the life expectancy of assembly 101.

Figure 6:
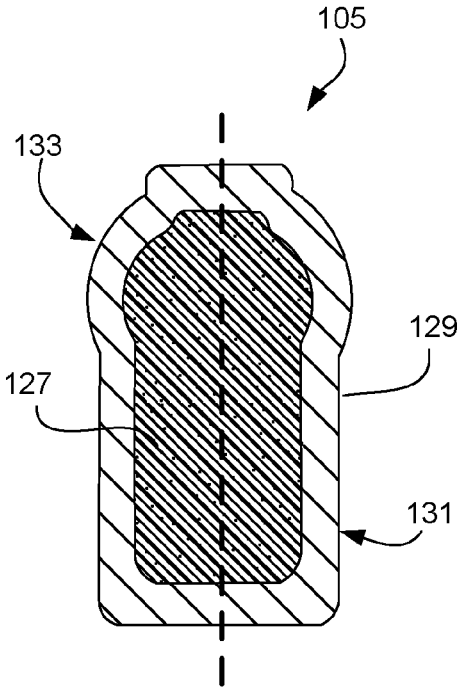
FIG. 6 is a side section view of a dart in the plunger assembly of FIG. 1.

Referring now also to FIG. 6 in the drawings, a side section view of dart 105 is illustrated. Dart 105 includes a core member 127 and a wear resistant coating 129. Coating 129 is similar in properties and purpose as that of wear pads 107 described previously. Dart 105 is subjected to abrasive conditions due to the working fluid. Dart 105 is partly unique in that it includes coating 129 as a protection to abrasive damage. Coating 129 is also configured to compress when under pressure. Coating 129 also provides some cushioning effect at impact with striker rod 92 and stop 94. Other key features associated with coating 129 will be described below. Core member 127 is a solid metallic member. Core member 127 is not limited to being without a hollowed interior or being made from metallic materials. Other embodiments are contemplated.

Dart 105 is configured to have a cylindrical shaft 131 and a bulbous upper end 133. Shaft 131 is configured to pass through dart aperture 123 as dart 105 operates between the upper seat 117 and lower seat 119. Bulbous end 133 is configured to seat within seats 117 and 119. When forces are applied by striker 92 and stop 94, coating 129 compresses and bulbous end 133 transitions between seats 117 and 119.

Figure 7:
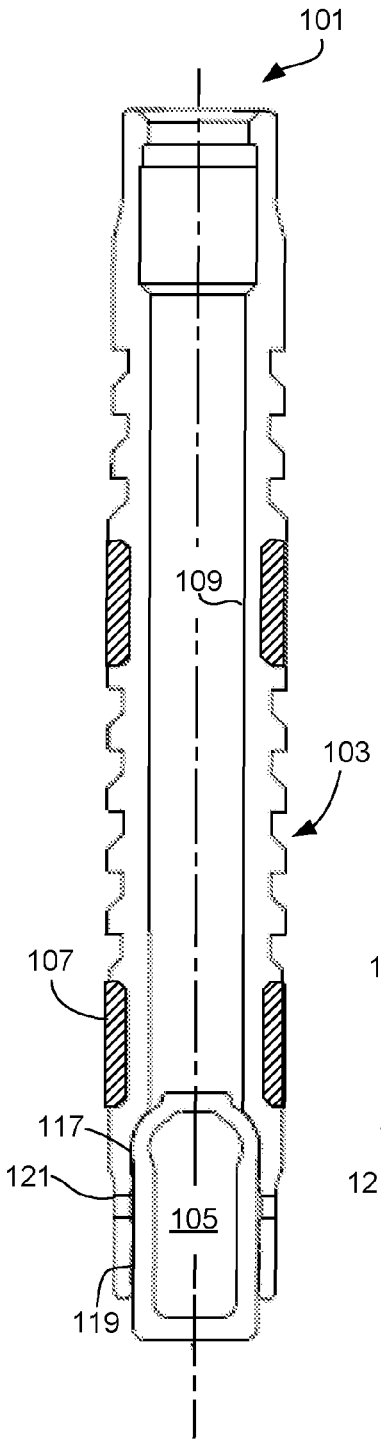
FIGS. 7-9 is are side section views of the plunger assembly of FIG. 1 with the dart of FIG. 6 shown in different operating positions.
Figure 8:
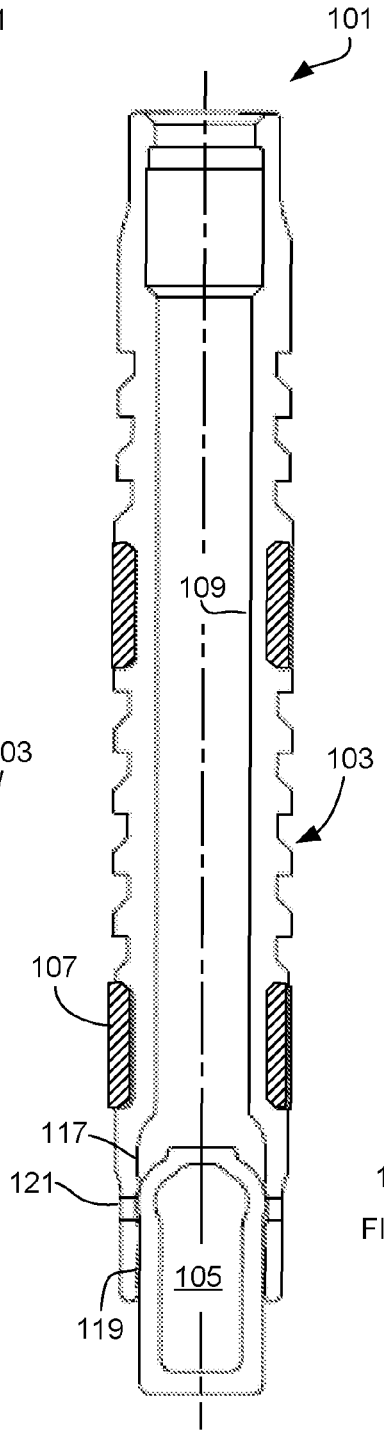
Figure 9:
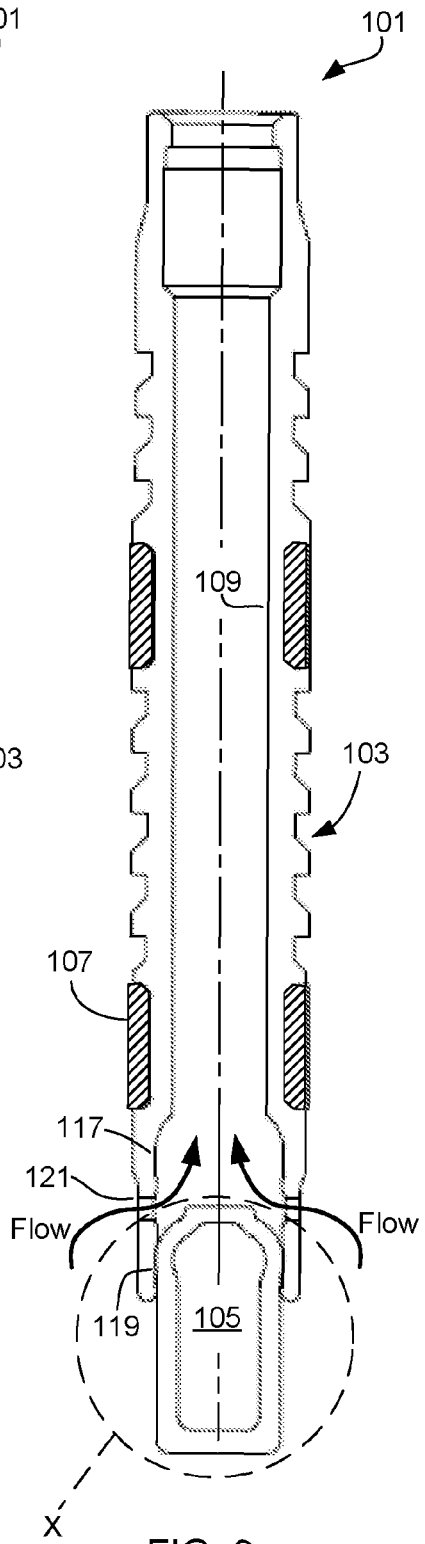

Referring now also to FIGS. 7-9 in the drawings, side section views of plunger assembly 101 are illustrated in different operating positions. In operation, plunger assembly 101 passes through tubing 90 either in a downward direction toward stop 94 or an upward direction toward striker rod 92. What makes assembly 101 traverse tubing 90 in either direction is the selective allowance of working fluid to pass through central channel 109. Assembly 101 falls downward in tubing 90 when working fluid is permitted to pass through ports 121 and through central channel 109 as noted by the arrows seen in FIG. 9. Upon contact with stop 94, ports 121 are closed and pressure differences in tubing 90 above and below body 103 result in the raising of assembly 101 upward in tubing 90 (see FIG. 7).

FIG. 7 illustrates assembly 101 configured to travel in an upward direction within tubing 90. Dart 105 is located in upper seat 117 thereby creating a seal against central section 113. Working fluid is obstructed by dart 105 from passing through ports 121. FIG. 9 illustrates assembly 101 configured to travel in a downward direction within tubing 90. Dart 105 is located in lower seat 119 thereby permitting the flow of working fluid through ports 121 and into channel 109. In FIG. 8, dart 105 is shown in transition between upper seal 117 and lower seal 119. Coating 129 is configured to compress during the transition between seats 117 and 119. Transitioning of dart 105 between seats 117 and 119 is due to contact between dart 105 and striker rod 92 and stop 94.

Dart 105 is interference fit lightly into each seat 117 and 119. Impact forces from striker rod 92 and stop 94 provide the force necessary to transition dart 105. The spherical radius contour of seats 117 and 119 are configured to permit an enhanced seal and control over the location of dart 105. Retention of dart 105, its sealing effects, and general operation are performed without additional components, such as clutches, retaining rings, set screws, and so forth. Seats 117 and 119 are formed in body 103 and allow for direct contact between dart 105 and body 103 during operation without obstruction from additional components. Therefore, the internal contour of body 103 is configured to guide, seat, seal, and secure dart 105.

Things to note with lower section 115 and dart 105 are: (1) that dart 105 is configured to extend below dart aperture 123 when seated in both the upper seat 117 and lower seat 119; and (2) dart 105 is configured to be interchangeable without the need for disassembly of body 103. Impact forces are used to transition dart 105 to allow for the selective passage of working fluid through ports 121. Assembly 101 is configured to route impact forces from stop 94 through dart 105 and directly to central section 113 of body 103, thereby bypassing lower section 115 and decreasing potential damage. Dart 105 protrudes through and below dart aperture 123 when in upper seat 117, therefore lower section 115 never contacts stop 94. This allows the contour and thickness of lower section 115 to be selectively tailored to increase flowrates and performance. The wall thickness of lower section 115 is relatively uniform and made narrower. By streamlining the exterior contours of lower section 115, a larger relative surface area dedicated to ports 121 may be realized and increased flow rates are achievable.

Figure 10:
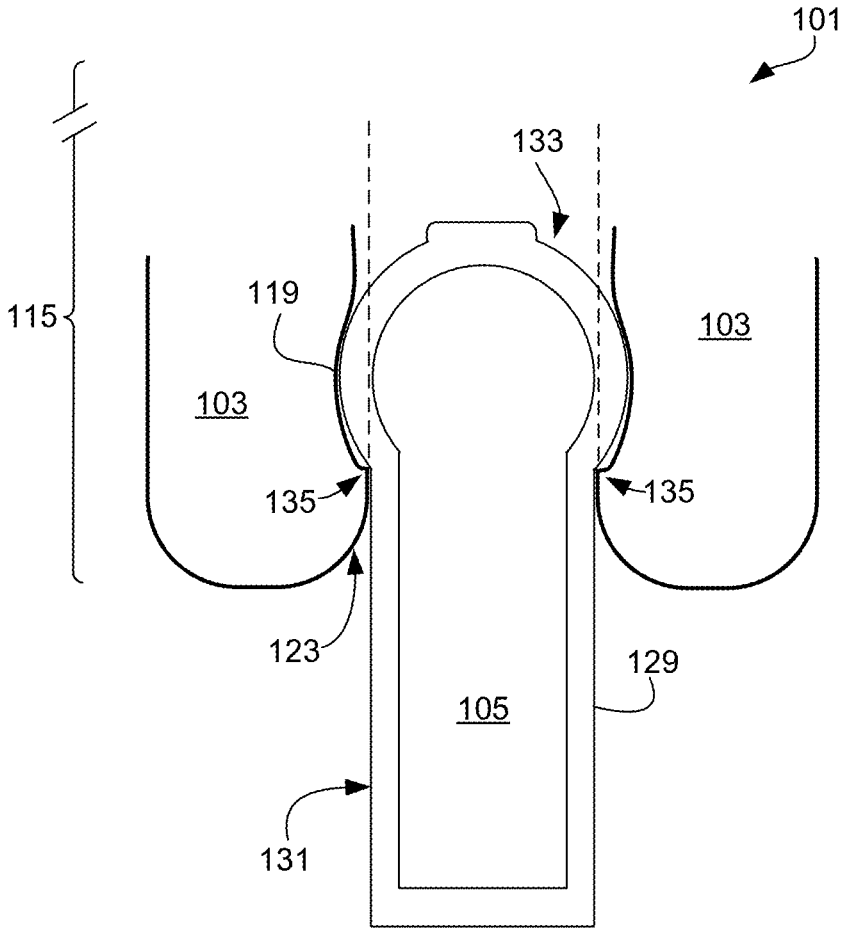
FIG. 10 is an enlarged side section view of a lower seat in the plunger body of FIG. 3 having an internal lip.

Referring now also to FIG. 10 in the drawings, an enlarged side section view of lower seat 119 and dart 105 are illustrated. As stated previously, body 103 is made as a unitary member. Body 103 is not made as an assembly of multiple parts having one or more couplings or connections. This makes the structure of body 103 more capable of withstanding impact forces. However, a unitary design has traditionally made the interchanging of dart 105 impractical or impossible.

Dart 105 is configured to be interchangeable from body 103. Dart 105 is configured to be pressed up through dart aperture 123 and secured in place within body 103 by use of an internal lip 135. Coating 129 on dart 105 is compressible and is configured to reduce in size as dart 105 passes through dart aperture 123 into body 103. Dart aperture 123 is configured to have a spherical radiused external surface that gradually decreases in diameter the further internally one progresses into body 103. The spherical radius acts to gradually compress coating 129 upon insertion. Although not necessary, the act of pressing dart 105 into body 103 may include the use of a lubricant.

Dart 105 and dart aperture 123 are selectively sized such that the bulbous end diameter of core member 127 has a maximum diameter less than the minimum internal diameter of dart aperture 123. It is the compressive nature of coating 129 that allows dart 105 to be inserted into body 103 without disassembly of body 103. However, it is the use of lip 135 that selectively retains dart 105 and prevents unauthorized or unintended removal. It is also of note that the uncompressed external diameter of coating 129 along shaft 131 is smaller than the minimum diameter of aperture 123. The degree of compression necessary to transition dart 105 between seats 117 and 119 is less than the degree of compression necessary to insert dart 105 through aperture 123.

Inside body 103 and adjacent seat 119, dart aperture 123 includes internal lip 135. Lip 135 is configured to have an edge to bite into or grip coating 129 and prevent the undesired removal of dart 105, and in particular, bulbous end 133 from exiting back through dart aperture 123. The relative sharp edge of lip 135, compared to the spherically radiused contour on the exterior or dart aperture 123, acts as a method of retention. Dart 105 may be removed through aperture 123 by pulling or pressing dart 105 and shearing off coating 129 at the bulbous end 133. The relative hardness of coating 129 is designed and selected such that the impact forces experienced by striker rod 92 are insufficient by itself to shear coating 129 and remove dart 105.

In use, the insertion and interchanging of dart 105 is simplified. No disassembly of body 105 is necessary. Plunger body 103 is secured first and the necessary force is be applied to dart 105 during removal and/or during installation. Force may be applied above dart 105 through channel 109 or may be applied beneath dart 105. Dart 105 is inserted into body 103 by compressing coating 129. During removal, coating 129 is sheared off bulbous end 133 from contact with internal lip 135.

It is understood that dart 105 is capable of being used with bodies being a combination of two or more components to avoid the need to disassemble the body, despite disassembly being possible. It is also understood that other plunger tools may utilize the feature of pads 107 to minimize exposure to corrosive wear without using a single body and/or dart 105 as described. Therefore, assembly 101 may use any combination of dart 105, body 103, and pads 107. Dart 105 and pads 107 are independent features which may be incorporated into existing plunger tool assemblies as a retrofit. The features of assembly 101 are customizable and tailored to specific needs.

The current application has many advantages over the prior art including at least the following: (1) single uniform plunger body with interchangeable dart; (2) wear pads to protect against corrosive wear; (3) wear pads are interchangeable to extend the life of assembly 101; and (4) transfer of impact forces directly to the central section of the plunger body.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plunger assembly for removing contaminants within a well bore, comprising:

a hollowed body configured to traverse between a striker rod and a stop within the well bore and remove contaminants and particulates within working fluid inside the well bore;

a centrally traversing dart within a lower section of the hollowed body, the dart configured to selectively close off the passage of working fluid through the hollowed body, the dart includes a core member and a wear resistant coating, the dart being configured to be interchangeable within the hollowed body and to pass through a dart aperture in the lower section; and a wear pad coupled to an exterior surface of the hollowed body, the wear pad configured to protect the hollowed body from exposure to the contaminants and particulates, the wear pads configured to be interchangeable;

wherein the lower section of the hollowed body includes an internal lip within the dart aperture, the internal edge configured to bite into the wear resistant coating of the dart and prevent undesired removal of the dart below the lower seat.

2. The assembly of claim 1, wherein the hollowed body is a single unitary body.

3. The assembly of claim 2, wherein the dart is interchangeable within the hollowed body.

4. The assembly of claim 1, wherein the core member is a solid core.

5. The assembly of claim 1, wherein the wear resistant coating of the dart is configured to selectively compress when transitioning between an upper seat and a lower seat.

6. The assembly of claim 1, wherein the wear resistant coating of the dart is configured to compress when being inserted through the dart aperture.

7. The assembly of claim 1, wherein dart aperture is sized to be larger than the diameter of the core member and smaller than the uncompressed diameter of the wear resistant coating of the dart.

8. The assembly of claim 1, wherein the lower section of the hollowed body includes an upper seat and a lower seat, the dart being configured to selectively transition between the upper seat and the lower seat; and wherein the dart is configured to extend below the lower section when located in both the upper seat and the lower seat.

9. The assembly of claim 8, wherein the dart is configured to contact the stop at the base of the well bore and transfer impact forces to the central section of the hollowed body, the central section located above the lower section adjacent the upper seat, the transfer of impact forces decreasing damage to the lower section of the hollowed body.

10. A plunger assembly for removing contaminants within a well bore, comprising:

a hollowed body configured to traverse along the length of the well bore and remove contaminants and particulates within working fluid inside the well bore; and a centrally traversing dart within a lower section of the hollowed body, the dart configured to selectively close off the passage of working fluid through the hollowed body, the dart including a core member and a wear resistant coating, the wear resistant coating configured to selectively compress and protect the core member;

wherein the dart is interchangeable within the hollowed body, the dart configured to pass through a dart aperture in the lower section without disassembly of the hollowed body; and wherein the dart aperture includes an internal lip and a spherically radiused outer surface, the spherically radiused outer surface configured to compress the wear resistant coating upon passage of the dart into the hollowed body, the internal lip configured to grip the wear resistant coating and prevent the undesired removal of the dart from the hollowed body.

11. The assembly of claim 10, wherein the hollowed body is a single unitary body.

12. The assembly of claim 10, wherein the wear resistant coating of the dart is configured to selectively compress when transitioning between an upper seat and a lower seat.

13. The assembly of claim 10, further comprising:

a wear pad coupled to an exterior surface of the hollowed body, the wear pad configured to protect the hollowed body from exposure to the contaminants and particulates, the wear pads configured to be interchangeable.

14. A method of servicing a plunger assembly, comprising:

securing the plunger body of the plunger assembly;

inserting a dart through a dart aperture in a lower section of the plunger body, the dart being configured to selectively compress; and removing the dart by passing the dart through the dart aperture, a section of the dart being sheared away upon removal through the dart aperture, the lower section of the plunger body including an internal lip to restrict removal;

wherein insertion of the dart into the lower section is done without disassembly of the plunger body.

15. The method of claim 14, further comprising:

interchanging a wear pad coupled to an exterior surface of the plunger body, the wear pad acting as a sacrificial part to prolong the life span of the plunger body.

* * * * *